US007556693B2

(12) United States Patent
Morita et al.

(10) Patent No.: US 7,556,693 B2
(45) Date of Patent: Jul. 7, 2009

(54) CURTAIN APPLICATOR

(75) Inventors: Hirofumi Morita, Tokyo (JP); Akio Hirano, Chiba (JP); Hiroyuki Kohno, Fukushima (JP)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 11/843,924

(22) Filed: Aug. 23, 2007

(65) Prior Publication Data

US 2008/0006203 A1 Jan. 10, 2008

Related U.S. Application Data

(63) Continuation of application No. PCT/EP2006/050304, filed on Jan. 19, 2006.

(51) Int. Cl.
*B05C 3/02* (2006.01)

(52) U.S. Cl. ..... 118/411; 118/325; 118/603; 118/612; 118/DIG. 2; 118/DIG. 4

(58) Field of Classification Search ..... 118/411, 118/325, 610, 602, 603, 419, DIG. 4, DIG. 2; 427/420

See application file for complete search history.

(56) References Cited

U.S. PATENT DOCUMENTS 3,303,816 A * 2/1967 Lauring ..... 118/603
4,019,906 A 4/1977 Ridley ..... 96/68
4,233,346 A 11/1980 Kerkhofs ..... 427/345
5,017,408 A * 5/1991 Kozak ..... 427/420
5,044,307 A * 9/1991 Takahashi et al. ..... 118/325
5,599,444 A * 2/1997 Baron et al. ..... 210/167.01

FOREIGN PATENT DOCUMENTS

JP 6300023 1/1988
JP 4131700 12/1992

* cited by examiner

*Primary Examiner*—Brenda A Lamb
(74) *Attorney, Agent, or Firm*—Taylor & Aust, P.C.

(57) ABSTRACT

This invention relates to a curtain applicator on which a two-layer curtain is formed by dispensing two types of coating medium, for example color, from a medium feeder positioned to the upper side of a moving web in order to apply two layers of coating medium onto the web surface. The medium feeder has a middle lip, which is arranged in the flow channels for the two types of medium and has a pointed part projecting toward the web side from the pointed parts of the two side lips which are arranged on the outer side of the flow channels for the two types of medium on the outer side in the width direction of the web. The curtain applicator also includes a convexly formed medium separation device, which adjoins the pointed part of the middle lip and individually separates the two types of surplus medium, for example, color, which are dispensed from the medium feeder.

4 Claims, 5 Drawing Sheets

CURTAIN APPLICATOR

CROSS REFERENCE TO RELATED APPLICATIONS

This is a continuation of PCT application No. PCT/EP2006/050304, entitled "CURTAIN APPLICATION UNIT", filed Jan. 19, 2006, which is incorporated herein by reference.

BACKGROUND OF THE INVENTION

1. Field of the Invention

This invention relates to a curtain applicator which is used to apply coating medium, for example color, in two layers onto a web surface.

2. Description of the Related Art

Up to now it was necessary, during the production of coated paper for use as general printing paper, for example for catalogs etc., pressure-sensitive paper, heat-sensitive paper and card paper for automatic card dispensing machines, to carry out dosing operations by way of a standard post-dosing applicator (a doctor coating unit) after applying color onto a web surface acting as base paper. Machines which are used for such applications of color are commonly known as applicators.

Up to now the most common of these applicators have used a post-dosing method with which a dosing operation is carried out after color is applied onto a web surface.

In the past few years, the color application step using a post-dosing applicator has been widely replaced by curtain applicators 100 on which, as is shown in the schematic cross-section of the main part of FIG. 4, a color ta is applied onto the web w running in the direction of the arrow by dispensing from an upper curtain head 101 in order to form a color curtain.

It should be noted that the publications cited below refer to examples of inventions which have already been disclosed and concern this application:

Cited publication 1, Japanese Patent No. S63-23; and

Cited publication 2, unexamined Japanese Utility Model Application No. H04-131700.

Two application methods are available as methods for applying two layers of color tb, tc onto a surface of the web w using the previously described curtain applicator.

In the case of the first application method, as shown in the schematic cross-section of the main part of FIG. 5, the colors tb, tc are dispensed from the upper curtain heads 201, 202 onto a web w running in the direction of the arrow in order to form individual single-layer color curtains cb, cc and to apply the colors tb, tc in two layers onto the surface of the web w. With this application method, the second layer of the color tc is applied prior to drying of the first layer of the color tb applied onto the surface of the web w.

However, with this application method the quantity of colors tb, tc dispensed from the curtain heads 201, 202 is small, for example less than 4 to 6 l/min·web width m, and the color curtains cb, cc are not very thick and cannot be used to form a normal curtain. Furthermore, blowing air over the applicator 200 causes slipping of the color curtains cb, cc, thus preventing the formation of a normal coating.

In the case of the second application method, as shown in the schematic cross-section of the main part of FIG. 6*a* and FIG. 6*b*, which is a view along the direction of arrow A in FIG. 6*a*, two-layer color curtains cd, ce are formed in advance by curtain heads 301, 302 and the application onto the web w running in the direction of the arrow is performed by the two-layer color curtains cd, ce.

With this application method the flow rates of the two curtains cd, ce are balanced in order to form the two-layer color curtains cd, ce, and if, for example, the flow rates of each of the color curtains cd, ce equals 5 l/min·web width m, then the overall flow rate produced is 10 l/min·web width m and the inertial force is increased, thus resulting in a reinforcement and stabilization of the color curtain and in the implementation of a stable coating.

FIG. 6*b* shows however that if, when using a curtain applicator 300 for the application, the curtain width cs is greater than the web width ws and the section of the curtain projecting from the web width is caught by the color recovery pan cp1, then the two colors td, te are mixed as shown in FIG. 6*a*. For this reason, if colors with different properties are to be applied, then it is difficult to reuse the mixed colors td, te and production losses occur.

With the first application method as described above it is possible on the other hand to recover each of the colors tb, tc individually because the color curtains cb, cc are completely separate.

Both methods have advantages and disadvantages; as such, the curtain applicators now available and used to perform a two-layer application are problematic.

What is needed in the art is a curtain applicator on which it is possible, when carrying out a two-layer application onto a web surface, to separate and recover the surplus color of the color curtain edge parts, and on which it is possible furthermore to stabilize the color curtain and perform a uniform coating.

SUMMARY OF THE INVENTION

The present invention provides, arranged on the curtain applicator, which is a curtain applicator on which two color layers are formed by dispensing two color types from a color feeder positioned to the upper side of a moving web in order to apply two color layers onto the web surface, a color feeder. The color feeder includes a middle lip, which is arranged in the flow channels for the two color types and has a pointed part projecting toward the web side from the pointed parts of the two side lips which are arranged on the outer side of the flow channels for the two color types on the outer side in the width direction of the web. Also arranged on the curtain applicator is a convexly formed color separation device, which adjoins the pointed part of the middle lip and individually separates the two types of surplus color dispensed from the color feeder.

Furthermore, the curtain applicator can include a first moving device for moving the color separation device in the web width direction.

Furthermore, the curtain applicator can include a plate-shaped guidance device which is arranged on the web side of the color separation device in order to align the edge part of the color curtain.

Furthermore, the curtain applicator can include a second moving device for moving the guidance device in the web width direction.

As described above, it is possible on the basis of one embodiment of the curtain applicator, owing to the fact that the color feeder includes a middle lip, which is arranged in the flow channels for the two color types and has a pointed part projecting toward the web side from the pointed parts of the two side lips which are arranged on the outer side of the flow channels for the two color types on the outer side in the width direction of the web, and a convexly formed color separation device, which adjoins the pointed part of the middle lip and individually separates the two types of surplus color dispensed from the color feeder, for the surplus of each of the colors not used for the coating to be separated and individually recovered.

For this reason the recovered color can be used again and the color loss during the application process can thus be reduced as far as possible.

On the basis of another embodiment of the curtain applicator, it is possible, owing to the fact that it includes a first moving device for moving the color separation device in the web width direction, for the surplus colors to be separated and individually recovered by moving the color separation device independently of the size of the web width dimension.

On the basis of another embodiment of the curtain applicator, it is possible, owing to the fact that it also includes a plate-shaped guidance device which is arranged on the web side of the color separation device of the color curtain in order to align the edge part of the color curtain, for the color curtain edge part to be stabilized.

On the basis of another embodiment of the curtain applicator, it is possible, owing to the fact that it includes a second moving device for moving the guidance device in the web width direction, for the surplus colors to be separated and individually recovered by moving the color separation device independently of the size of the web width dimensions.

The description of the invention will mainly use the term "color" and color separation device, color types or color curtain respectively. It should be noted however that the invention relates in general to the application of a coating medium.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
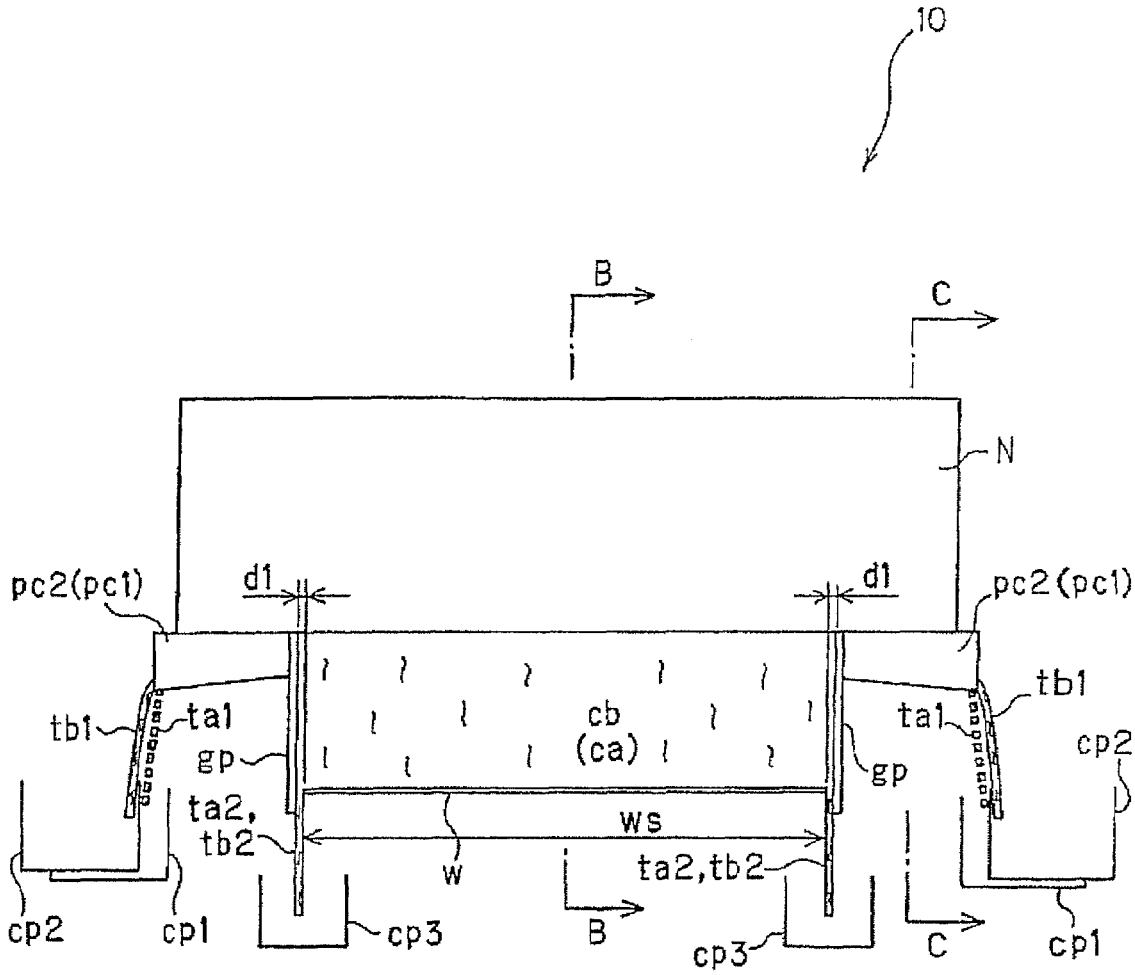
FIG. 1 shows a schematic front view of the curtain applicator related to an embodiment of the current invention.
Figure 2B:
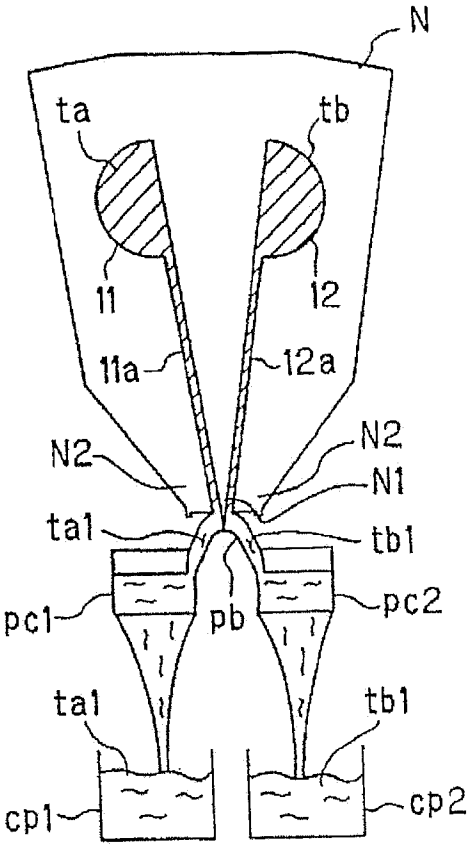
FIG. 2*b* shows a cross section along the line C-C in FIG. 1.
Figure 2A:
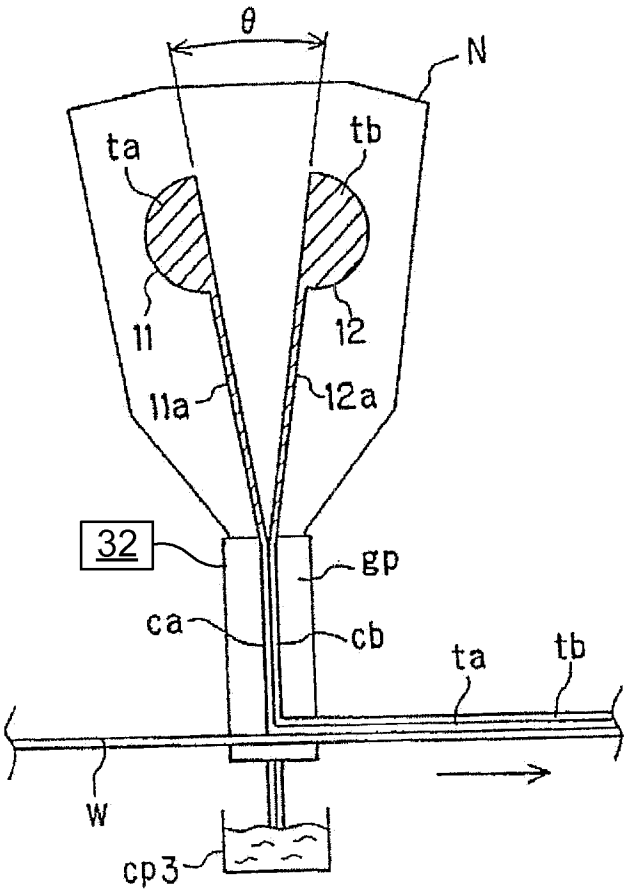
FIG. 2*a* shows a cross section along the line B-B in FIG. 1.

Referring now to the drawings, and more particularly to FIG. 1, there is shown a schematic front view of one embodiment of a curtain applicator 10 on which the current invention finds application, and FIG. 2*a* is a cross section along the line B-B in FIG. 1, and FIG. 2*b* is a cross section along the line C-C in FIG. 1.

The curtain applicator 10 dispenses, by way of a color feeder N, a color ta from a first curtain head 11 and a color tb from a second curtain head 12 respectively, whereupon, through the formation of two-layer color curtains ca, cb (see FIG. 2 *a*), two layers of the colors ta, tb are applied onto a surface of the web w running in the direction of the arrow.

In its middle region the curtain applicator 10 creates a stable color curtain region in that, as shown in FIG. 1, it dispenses the two-layer color curtains ca, cb in widths greater than the web width ws, whereupon the coating is implemented with uniform color curtains.

It should be noted that, as shown in FIG. 2*a*, an angle q of between 15 and 30° is set between the flow channels 11*a*, 12*a* of the first curtain head 11 and the second curtain head 12 respectively. The angle θ lies preferably in this prescribed value range because the dimensions of the color feeder N would be too great if the angle were bigger.

As shown in the FIGS. 1 and 2*b*, the surplus colors ta1, tb1 on the outer side in the width direction of the web, which are not used to coat the web surface, are individually separated and caught by special color recovery pans cp1, cp2.

In this way the recovered colors ta1, tb1 are returned to feed containers (not shown in the drawings) for each of the colors ta, tb, and they are recirculated and fed again to the first curtain head 11 and second curtain head 12 respectively.

To increase the stability between the colors ta, tb used for the coating and the individually separated surplus colors ta1, tb1, which are not used for the coating, provision is made, as shown in FIG. 1, for guide plates (plate-shaped guidance device) gp, gp for orientation of the edge parts of the color curtains ca, cb.

The guide plates gp, gp stabilize the color curtains ca, cb and divide them into colors ta, tb, which are used for the coating, and individually separated surplus colors ta1, tb1, which are not used for the coating.

This means that by way of the moving guide plates gp, gp, which are arranged on the outer side in the width direction of the web, it is possible for the width of the color curtains ca, cb directly used for coating the surface of the web w to be optimally adjusted in order to concur with the width ws of the web w to be coated.

The guide plates gp, gp are made of flexible foil or the like, and to prevent resistance to the liquid flow of the curtains they are configured with a smooth surface.

On the embodiment in question, the flow of the colors ta, tb is improved and stable color curtains ca, cb can be created for example by fastening a polypropylene foil with a thickness of 50 to 100 μm to a thin brass or aluminum plate and aligning the color curtains ca, cb by way of the polypropylene plate.

To improve the flow of the colors ta, tb in the contact region with the guide plates gp and to prevent a disturbance of the color curtains ca, cb, the guide plates gp touching the color curtains ca, cb can form an element with a smooth surface and low coefficient of friction.

It should be noted that, as shown in FIG. 1, owing to the little disturbance of the curtains arising in the contact region between the edge parts of the color curtains ca, cb and the guide plates gp, a gap with the dimension dl (=3 to 5 mm) is created in a region between the web w and the guide plates gp, and the colors ta2, tb2 of this region which are not used for the coating are caught by the color recovery pan cp3.

It should be noted that the guide plates gp, owing to their configuration of a thin metal plate and a propylene foil, can be bent and plastically formed, whereupon the optimum form of the guide plates gp for creating a stable color curtain can easily be made.

Figure 3A:
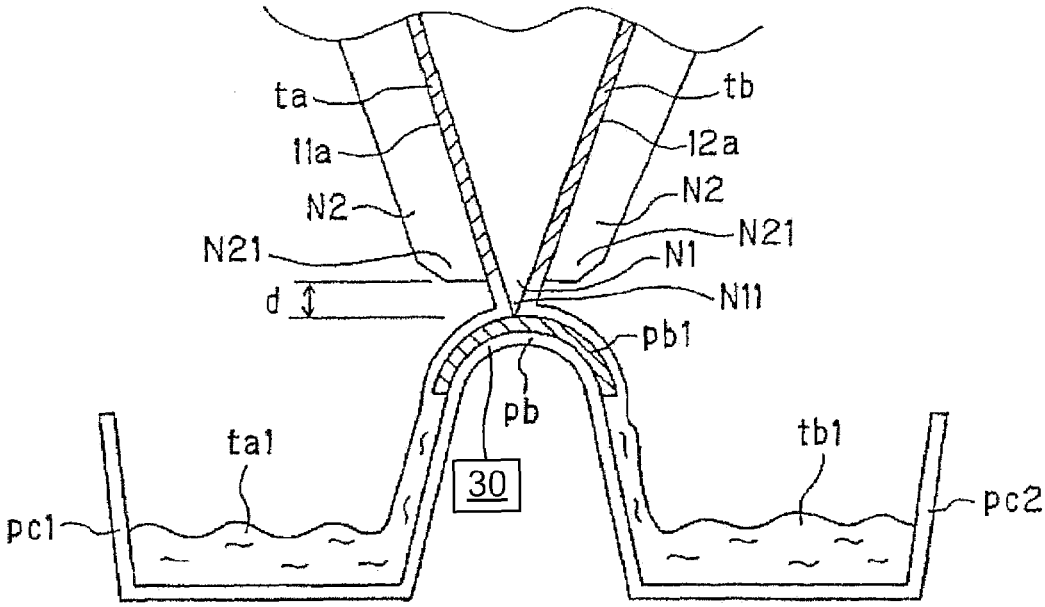
FIG. 3*a* shows an enlarged view of the middle lip and the separation plate which are presented in FIG. 2*b;*

FIG. 3*a* shows an enlarged view along the middle lip N1 and separation plate pb according to the representation in FIG. 2*b*.

The configuration shown in FIG. 2*b* and FIG. 3*a* forms a configuration with which the surplus colors ta1, tb1 not used for the coating can be individually separated.

This means that a pointed part N11 of a lip N1 arranged centrally between the flow channels 11*a*, 12*a* of a two-layer color feeder N is provided such that it projects 0.5 to 10 mm (dimension d in FIG. 3*a*) downward to the w side of the web from the pointed part N21 of the two side lips N2, N2 on the outer side of the flow channels 11*a*, 12*a*. It should be noted that the dimension d, by which the pointed part N11 of the middle lip N1 projects downward to the web side from the pointed parts N21, N21 of the two side lips is not limited to this value and can exceed it by 10 mm.

Furthermore, a separation plate (the color separation means) pb with a forward-projecting curved form adjoins the pointed part Nil of the middle lip N1 and spatially separates the two dispensed types of color ta, tb such that the two colors ta, tb are individually separated without mixing.

As shown in FIG. 3*a*, each of the surplus colors ta1, tb1, which are separated by the middle lip N1 and the separation plate pb without mixing, flows along the separation plate pb and drops into the storage containers pc1, pc2.

Because the storage containers pc1, pc2, which catch the colors ta1, tb1, as shown in FIG. 1, have a downward gradient to the special recovery pans cp1, cp2, the color ta1 of the storage container pc1 and the color tb2 of the storage container pc2 flow to the special recovery pans cp1 and cp2 respectively where they are recovered.

Figure 3B:
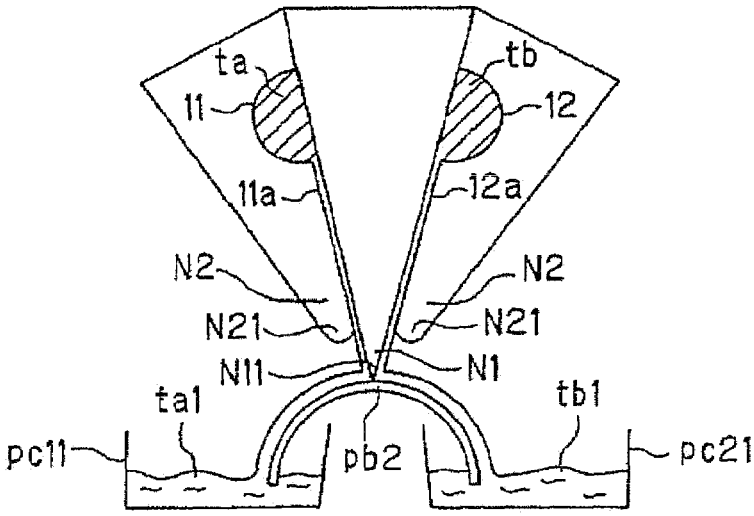
FIG. 3*b* shows a schematic cross section of a modified example of the separation plate and the storage container.
Figure 4:
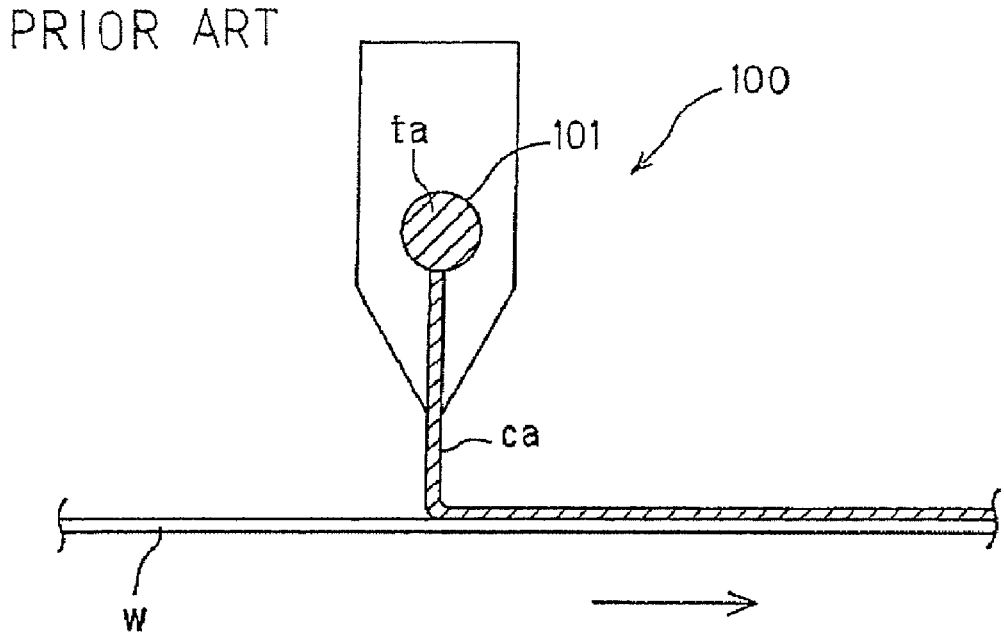
FIG. 4 shows a schematic cross section of the main part of an example of a curtain applicator according to the prior art.
Figure 5:
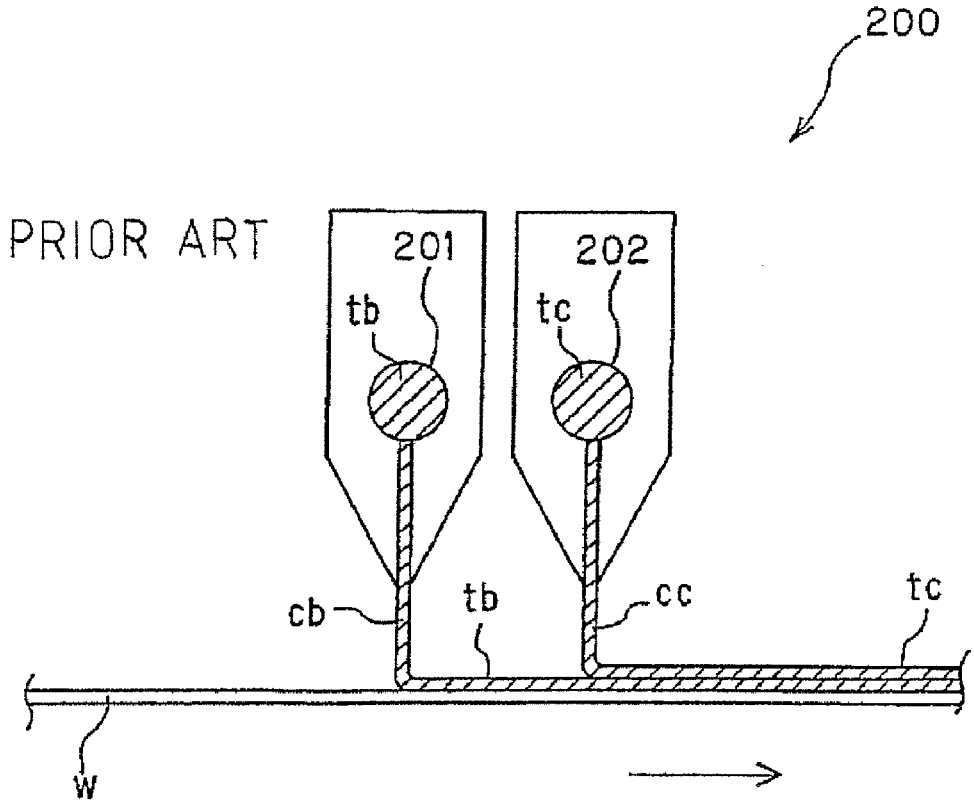
FIG. 5 shows a schematic cross section of the main part of an example of a two-layer curtain applicator according to the prior art.
Figure 6A:
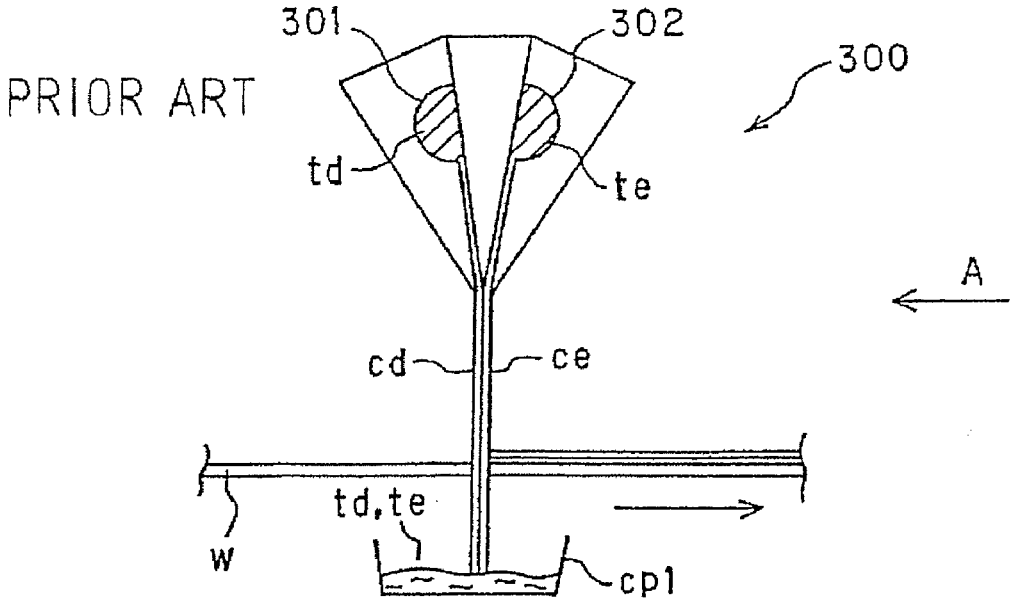
FIG. 6*a* shows a schematic cross section of the main part of another example of a two-layer curtain applicator according to the prior art.
Figure 6B:
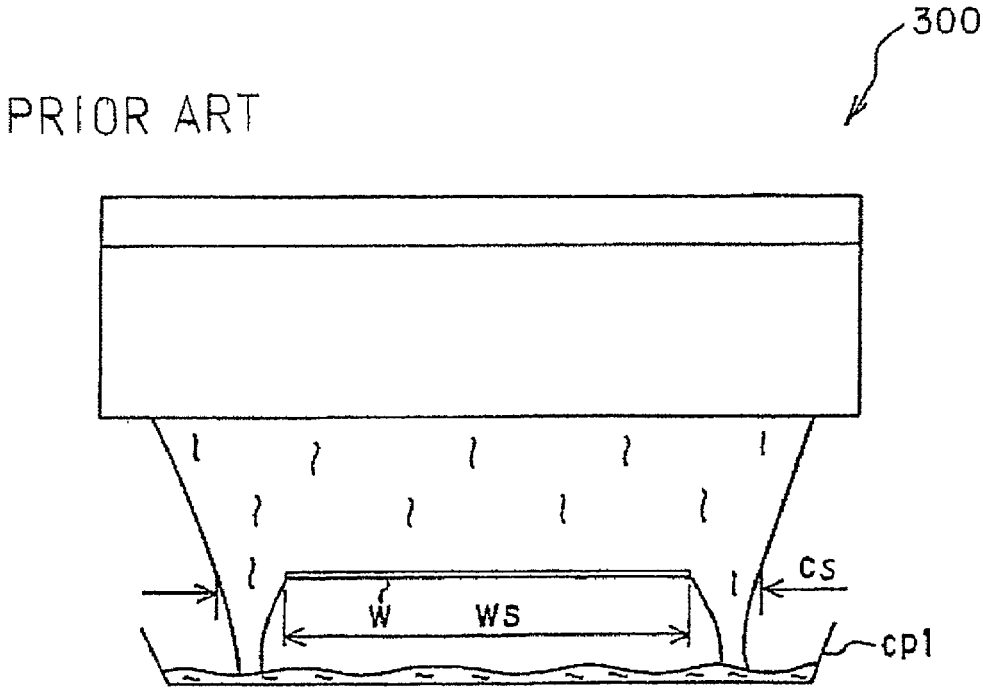
FIG. 6*b* shows a view along the direction of the arrow A in FIG. 6*a*.

As shown in FIG. 3 *a*, an elastic material (the color separation device) pb1 such as a rubber foil or a resin material is fastened here in order to prevent damage to the middle lip N1 due to knocking of the separation plate pb against the pointed part N11 of the middle lip N1. It should be noted that it is also possible to use a configuration on which no elastic material pb1 is used but on which instead the separation plate pb itself is elastic.

Although the present invention is represented by an example on which the separation plate pb and the storage containers pc1, pc2 are integrally constructed using a curved plate of stainless steel as shown in FIG. 3*a*, it is also possible for the separation plate (the color separation device) pb2 and the storage containers pc11, pc21 to be provided separately. As long as the separation plate is configured such that it projects forward and adjoins the pointed part N11 of the middle lip N1 in order to separate the surplus colors ta1, tb1, then the configuration of the separation plate and the storage containers and the like can be selected as appropriate.

Furthermore, the configuration can include a first moving device 30 for moving the above described separation plate pb and the storage containers pc1, pc2 etc. in the width direction and a second moving device 32 for moving the guide plates gp, gp in the width direction.

On the basis of these configurations it is possible, when the width dimension of the web to be coated is changed, to obtain an optimum adjustment by moving the guide plates gp, gp and the separation plate pb and the storage containers pc1, pc2 in the width direction w, whereupon the edge parts of the color curtains ca, cb are stabilized and the surplus colors ta1, tb1 can be individually separated and recovered.

It should be noted that these moving devices can be constructed as a single configuration which integrally moves the guide plates gp, gp and the separation plate pb and the storage containers pc1, pc2 etc., and that the type of configuration of the moving devices can be selected as appropriate.

On the basis of the above described configurations it is possible, owing to the fact that the surplus colors ta1, tb1 are individually separated by the middle lip N1 and the separation plate pb etc. and recovered and reused by way of the special recovery pans cp1, cp2, to decrease the amount of color which inevitably becomes mixed and to reduce color loss as far as possible.

Through alignment of the edge part of the color curtains ca, cb by the guide plates gp, gp it is possible in addition to achieve a stabilization of the edge parts of the color curtains ca, cb, and it is possible to set the optimum width of the color curtains ca, cb relative to the width of the web w, whereupon a uniform coating can be created accordingly.

Owing to the fact that the device includes moving devices for moving each of the guide plates gp, gp and the separation plate pb and the storage containers pc1, pc2 in the width direction, it is possible to adjust the position of the guide plates gp, gp and the separation plates pb, pb etc. such that said position is aligned to the width of the web to be coated regardless of the width dimension of the web, to achieve a stabilization of the edge parts of the color curtains ca, cb, and to individually separate and recover the surplus colors ta1, tb1.

Accordingly, a curtain applicator which creates a stable two-layer coating with little color loss can be obtained.

It should be noted that although the above described embodiment presents an example on which the guide plates gp, gp and the separation plates pb, pb and the storage containers pc1, pc2 etc. are arranged on two sides of the web w, it is also possible for them to be arranged on only one side of the web w, and it goes without saying that the same effect can be achieved on only the one side of the web w.

Practical examples of the use to which the current invention can be put are on applicators for applying color to calendars, catalogs, pressure-sensitive paper, heat-sensitive paper and photographic film for example, as well as on applicators or the like for applying medium onto a magnetic material on one side of cards for automatic platform barriers.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

10 Curtain applicator
11*a*, 12*a* Flow channel
ca, cb Curtain/color curtain
gp Guide plate (guidance means)
N Medium feeder/color feeder
N1 Middle lip
N11 Pointed part of the middle lip
N2 Lips from two sides (lips on two sides)
N21 Pointed part of the lips from two sides (pointed lip parts on two sides)
pb Separation plate (medium separation means/color separation means)
pb1 Elastic element (medium separation means/color separation means)

pb2 Separation plate (medium separation means/color separation means)

ta, tb Coating medium/color ta1, tb1 Surplus medium/color w Web

What is claimed is:

1. A curtain applicator on which a two-layer curtain is formed, said curtain applicator comprising:

a medium feeder configured for forming the two-layer curtain by dispensing two types of a coating medium, said medium feeder extending across a width of a web moving in a given direction and positioned above said moving web in order to apply two layers of said coating medium onto a web surface of said moving web, said medium feeder including a middle lip having a first side and a second side, and two side lips, one side lip arranged upstream from the first side of the middle lip with a first channel for applying a first layer of the curtain arranged therebetween and the other side lip arranged downstream from the second side of the middle lip with a second channel for applying a second layer of the curtain arranged therebetween, and said two side lips each including a pointed part, an end of said middle lip including a pointed part projecting further toward the web surface than said pointed parts of said two side lips; and a convex shaped medium separation device which is in contact with said pointed part of said middle lip and is configured for contacting a portion of a surplus of said coating medium which is dispensed from said medium feeder and for maintaining separate the two types of coating medium in said portion of surplus coating medium dispensed from said medium feeder.

2. The curtain applicator according to claim 1, further comprising a first moving device for moving said medium separation device in said width direction of said web.

3. The curtain applicator according to claim 1, further comprising a plate-shaped guidance device which is arranged on a web side of said medium separation device in order to align an edge part of the two-layer curtain.

4. The curtain applicator according to claim 3, further comprising a second moving device for moving said guidance device in said width direction of said web.

* * * * *

UNITED STATES PATENT AND TRADEMARK OFFICE

CERTIFICATE OF CORRECTION

PATENT NO. : 7,556,693 B2
APPLICATION NO. : 11/843924
DATED : July 7, 2009
INVENTOR(S) : Hirofami Morita et al.

It is certified that error appears in the above-identified patent and that said Letters Patent is hereby corrected as shown below:

COLUMN 5 line 22, please delete "Nil"; and substitute therefore --N11--.

Signed and Sealed this

Twenty-third Day of February, 2010

David J. Kappos

David J. Kappos
*Director of the United States Patent and Trademark Office*